US007173512B2

(12) United States Patent
Ko et al.

(10) Patent No.: US 7,173,512 B2
(45) Date of Patent: Feb. 6, 2007

(54) THERMISTOR HAVING IMPROVED LEAD STRUCTURE AND SECONDARY BATTERY HAVING THE THERMISTOR

(75) Inventors: Chang-Mo Ko, Seoul (KR); Su-An Choi, Gyeonggi-do (KR); Jun-Ku Han, Seoul (KR); An-Na Lee, Seoul (KR); Jong-Hwan Lee, Gyeonggi-do (KR); Ju-Dam Kim, Seoul (KR); Jong-Ho Lee, Gyeonggi-do (KR); Jong-Seo Yoon, Seoul (KR)

(73) Assignee: LG Cable, Ltd., Seoul (KR)

( * ) Notice: Subject to any disclaimer, the term of this patent is extended or adjusted under 35 U.S.C. 154(b) by 252 days.

(21) Appl. No.: 10/888,309

(22) Filed: Jul. 9, 2004

(65) Prior Publication Data

US 2005/0206494 A1 Sep. 22, 2005

(30) Foreign Application Priority Data

Mar. 17, 2004 (KR) ..... 10-2004-0018160

(51) Int. Cl.
*H01C 7/10* (2006.01)

(52) U.S. Cl. ..... 338/22 R; 338/254; 338/328

(58) Field of Classification Search ..... 338/22 R, 338/22 SD, 238, 249, 254, 265, 266, 272, 338/276, 322, 324, 328, 329; 219/541; 429/62, 429/56, 121; 361/93.1

See application file for complete search history.

(56) References Cited

U.S. PATENT DOCUMENTS 4,232,214 A * 11/1980 Shioi et al. ..... 338/22 R
4,635,026 A * 1/1987 Takeuchi ..... 338/22 SD
5,766,793 A * 6/1998 Kameishi et al. ..... 429/62
6,700,766 B2 * 3/2004 Sato ..... 361/93.1

FOREIGN PATENT DOCUMENTS

KR 10-2004-57365 7/2004

* cited by examiner

*Primary Examiner*—Tu Hoang
(74) *Attorney, Agent, or Firm*—Jones Day

(57) ABSTRACT

A thermistor of which resistance is changed depending on temperature and a secondary battery to which the thermistor is attached are disclosed. The thermistor is attached to an object via a lead which is made of different kinds of materials. The lead is configured so that a part of the lead to be united to the thermistor electrode is mainly made of the same material as the electrode and a part of the lead to be united to the object is mainly made of the same material as the surface of the object. Thus, the thermistor may be simply attached to the object only using the ultrasonic welding, thereby remarkably reducing junction inferiorities.

4 Claims, 2 Drawing Sheets

THERMISTOR HAVING IMPROVED LEAD STRUCTURE AND SECONDARY BATTERY HAVING THE THERMISTOR

BACKGROUND OF THE INVENTION

1. Field of the Invention

The present invention relates to a thermistor of which resistance is changed depending on temperature and a secondary battery to which the thermistor is attached, and more particularly to a combination structure of the thermistor and an object to which the thermistor is to be attached.

2. Description of the Related Art

A thermistor is a resistance element using a phenomenon that a specific resistance changes depending on temperature. The thermistor may employ NTC (Negative Temperature Coefficient) material whose resistance is decreased as temperature increases or PTC (Positive Temperature Coefficient) material whose resistance is increased as temperature increases. In particular, the PTC material shows a relatively low resistance at a normal temperature to allow electric current to flow through, while its resistance increases as much as 1,000 to 10,000 times of its origin state if a temperature of the material is increased due to an excess current or a surrounding temperature is increased, thereby interrupting an electric current. Thus, by using such a characteristic, the PTC material is commonly used for protecting various electronic parts from overheating or excess current. Such a thermistor is classified into a surface-mounted thermistor which is mounted on a surface of a substrate such as a printed board, and an attaching-type thermistor which is attached to an object such as a secondary battery.

Meanwhile, the secondary battery capable of being charged or discharged has low stability, namely it involves some risk of explosion resulting from abnormal states such as excess charging or excess discharging. Thus, a protection circuit or a PTC thermistor is commonly attached to the most secondary batteries in order to sense excess charging or excess discharging of a battery cell and then selectively isolating connection to an external circuit.

FIG. 1 shows a combination structure of a thermistor and a secondary battery to which the thermistor is to be attached. Referring to FIG. 1, a PTC thermistor 10 has upper and lower electrodes 12 and 14 on both sides of a PTC material layer 13. Upper and lower leads 11 and 15 are attached to the upper and lower electrodes 12 and 14, respectively. Meanwhile, a secondary battery cell can 30 to which the PTC thermistor 10 is to be attached is generally made of aluminum, and the lower lead 15 is generally made of nickel. Thus, in order to facilitate attachment between the lower lead 15 and the secondary battery cell can 30, which are made of different materials, a nickel-aluminum clad strip 20 is used. That is to say, the nickel-aluminum clad strip 20, configured so that a layer 21 to be combined with the lower lead 15 is made of nickel and a layer 22 to be combined with the secondary battery cell can 30 is made of aluminum, is inserted between the lower lead 15 and the secondary battery cell can 30. Then, the nickel layer 21 of the nickel-aluminum clad strip 20 is attached to the lower lead 15 by means of the spot welding 41, while the aluminum layer 22 is attached to the secondary battery cell can 30 by means of the supersonic welding 42.

The spot welding is a kind of resistance welding, which unites junction surfaces by pressing them at a high temperature or in a melted state by means of Joule heating around a welding spot. However, the spot welding requires too many and complicated process factors affecting on the welding, so it is not easy to obtain a high-quality junction. That is to say, the spot welding may give a junction of a desired quality only when three correlated process factors of a welding current, a dwell time and a pressing force should be controlled accurately. If any of the factors is not exactly controlled, it easily causes an inferior junction, like separation of a welded portion or easy detachment even by a weak impact.

In addition, in the combination structure of the thermistor and the secondary battery shown in FIG. 1, the spot welding 41 and the ultrasonic welding 42 are inevitably interposed, so a clearance on the surface of the welded portion is hardly ensured, thereby being apt to cause an inferior junction between the aluminum layer 22 of the nickel-aluminum clad strip 20 and the secondary battery cell can 30.

SUMMARY OF THE INVENTION

The present invention is designed to solve the problems of the prior art, and therefore it is an object of the present invention to provide a thermistor which enables easy and secure combination to an object to which the thermistor is to be attached, and a secondary battery to which the thermistor is attached.

In order to accomplish the above object, the present invention provides a thermistor attached to an object via a lead which is made of different kinds of materials, wherein the lead is configured so that a part of the lead to be united to a thermistor electrode is mainly made of the same material as the electrode and a part of the lead to be united to the object is mainly made of the same material as the surface of the object.

That is to say, the thermistor, which is, to be, attached to a surface of an object by welding in order to protect the object from overheating or excess current, includes a resistance material layer of a sheet shape, of which electric resistance is changed depending on temperature; first and second electrodes respectively formed on both sides of the sheet-shaped resistance material layer; and first and second leads respectively formed on the first and second electrodes, wherein the second lead has first and second layers, which are mainly made of different materials, wherein the first layer of the second lead to be united to the second electrode is mainly made of the same material as the second electrode, and wherein the second layer of the second lead to be united to a surface of the object is mainly made of the same material as the surface of the object.

Here, the first and second layers of the second lead may be an alloy made of different materials, and the first and second layers may be clad with different kinds of metals.

In particular, the thermistor may be attached by welding so that the second layer is contacted with the surface of the secondary battery. In this case, it is preferably that the first layer of the second lead is mainly made of the same material as the second electrode (e.g., nickel) and the second layer is mainly made of the same material as the surface of the secondary battery (e.g., aluminum).

By configuring the lead to be combined to the object with at least two different materials which mainly include the same materials as the electrode of the thermistor and the surface of the object respectively, the thermistor may be securely and easily attached to the surface of the object only using the ultrasonic welding.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Hereinafter, preferred embodiments of the present invention will be described in detail referring to the accompanying drawings. Prior to the description, it should be understood that the terms used in the specification and appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

Figure 1:
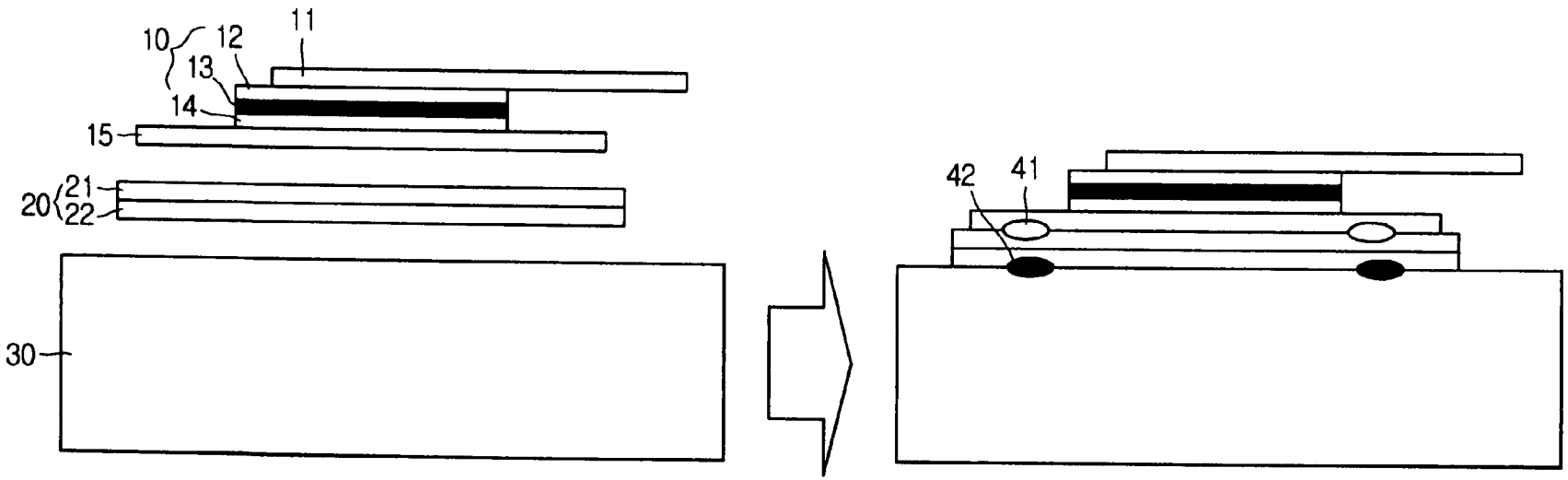
FIG. 1 PRIOR ART
FIG. 1 is a sectional view showing a combination structure of a thermistor and an object to which the thermistor is to be united according to the prior art.
Figure 2:
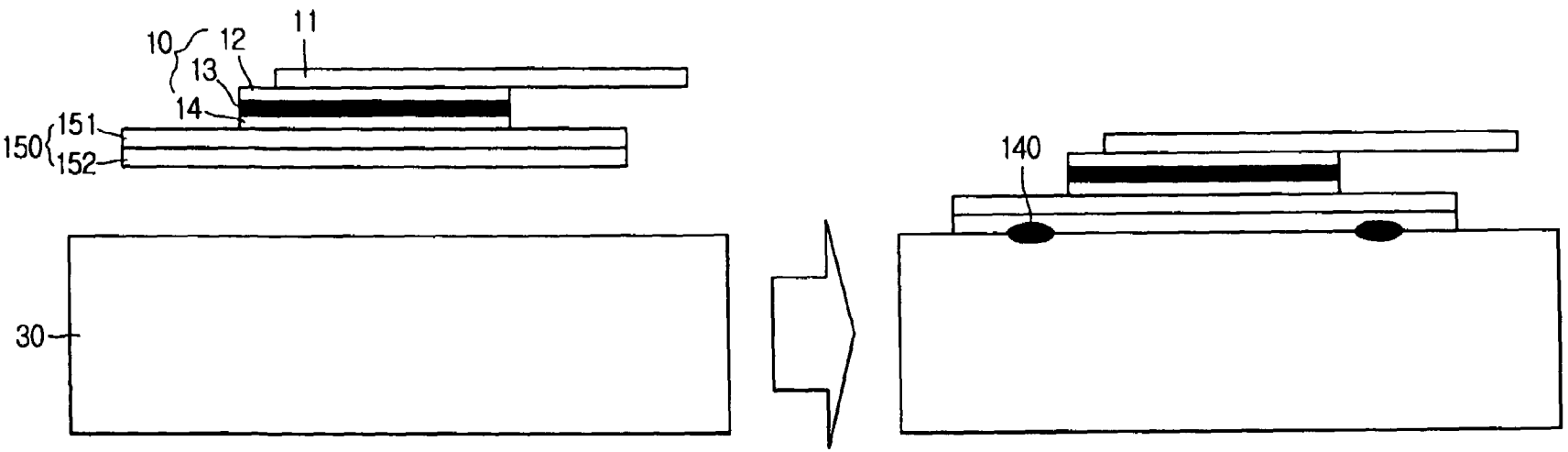
FIG. 2 is a sectional view showing a combination structure of a thermistor and an object to which the thermistor is to be united according to the present invention.

FIG. 2 is a sectional view schematically showing a combination structure of a thermistor and a secondary battery, which is an object to which the thermistor is to be attached, according to a preferred embodiment of the present invention. In FIG. 2, the same reference numeral as FIG. 1 designates the same element, and it is not described in detail here.

Referring to FIG. 2, the thermistor of this embodiment includes upper and lower electrodes 12 and 14 on both surfaces of a PTC material layer 13. Upper and lower leads 11 and 150 are respectively attached to the upper and lower electrodes 12 and 14. Here, in the lower lead 150, upper and lower layers 151 and 152, which are made of different materials, are clad. The upper layer 151 that is to be directly united to the lower electrode 14 of the thermistor 10 is made of the same material as the electrode, for example nickel mainly, so that it may be easily united to the lower electrode 14. In addition, the lower layer 152 that is to be united to a secondary battery cell can 30, to which the thermistor is to be attached, is made of the same material as the secondary battery cell can, for example aluminum mainly, so that it may be easily united to the secondary battery cell can 30.

In the combination structure of this embodiment, the thermistor may be attached to the object only by the ultrasonic welding. That is to say, as shown in FIG. 2, since the combination structure of this embodiment needs only a welding 140 between the lower lead 150 and the secondary battery cell can 30, the attachment process is finished only with the ultrasonic welding. Thus, the present embodiment does not require for conducting the spot welding, which is apt to cause inferiority due to complex welding conditions and complicated process control. In addition, differently from the conventional combination structure, an inferior welding due to interposition of two welding portions is not aroused in this embodiment, so an inferiority rate may be remarkably reduced, compared with the conventional one.

Meanwhile, the lower lead 150 of this embodiment composed of two layers may form the upper and lower layers 151 and 152 by means of lamination of metal films. In addition, the upper layer 151 of the lower lead 150 may be united to the lower electrode 14 of the thermistor by means of the soldering.

The thermistor and the secondary battery according to this embodiment may be modified in various ways.

For example, in the aforementioned embodiment, though it is described that the object is the secondary battery cell can 30, any electric part may be used as the object if it may prevent overheating or excess current with the thermistor attached thereto by welding.

In addition, though it is depicted and described in the embodiment that the lower lead 150 has two layers 151 and 152, the lower lead 150 is not limited such a configuration, and may have three or more layers. Furthermore, each layer of the lower lead 150 may be one kind of material, but it may also be made of an alloy of the main material and other materials if it shows good conductivity and attachability.

Moreover, though it is depicted and described in the embodiment that the lower lead 150 has two separate layers, the lower lead 150 may be made of an alloy whose composition ratio is continuously changed along a thickness direction. That is to say, the lower lead 150 is made of an alloy having different materials with a controlled component ratio so that a part of the lower lead 150 to be united to the lower electrode 14 is mainly made of the same material as the lower electrode 14 and a part of the lower lead 150 to be united to the surface of the object 30 is mainly made of the same material as the surface of the object.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

APPLICABILITY TO THE INDUSTRY

According to the present invention, it is possible to remarkably reduce junction inferiorities since the thermistor may be simply united to an object only using the ultrasonic welding, by composing a lead of the thermistor, which is to be united to the object, with different kinds of materials, and then configuring the lead so that a part of the lead to be united to the thermistor electrode is mainly made of the same material as the electrode and a part of the lead to be united to the object is mainly made of the same material as the surface of the object.

What is claimed is:

1. A thermistor which is to be attached to a surface of an object by welding in order to protect the object from overheating or excess current, the thermistor comprising:

a resistance material layer of a sheet shape, of which electric resistance is changed depending on temperature;

first and second electrodes respectively formed on both sides of the sheet-shaped resistance material layer; and first and second leads respectively formed on the first and second electrodes, wherein the second lead is made of an alloy having different main materials, wherein a part of the second lead to be united to the second electrode is mainly made of the same material as the second electrode, wherein a part of the second lead to be united to a surface of the object is mainly made of the same material as the surface of the object, and wherein the second lead is formed with a single layer and a composition ratio of the second lead is continuously changed along a thickness direction thereof.

2. A thermistor according to claim 1, wherein the part of the second lead to be united to the second electrode is mainly made of nickel, and the part of the second lead to be united to the surface of the object is mainly made of aluminum.

3. A secondary battery, to a surface of which the thermistor defined in the claim 1 is attached.

4. A secondary battery according to claim 3, wherein the thermistor is attached to the surface of the secondary battery by means of ultrasonic welding.

* * * * *

UNITED STATES PATENT AND TRADEMARK OFFICE

CERTIFICATE OF CORRECTION

PATENT NO. : 7,173,512 B2
APPLICATION NO. : 10/888309
DATED : February 6, 2007
INVENTOR(S) : Ko et al.

It is certified that error appears in the above-identified patent and that said Letters Patent is hereby corrected as shown below:

On the title page item (22), replace "Jul. 9, 2004" with -- Jul. 8, 2004 --.

Signed and Sealed this

Twenty-fourth Day of April, 2007

JON W. DUDAS
*Director of the United States Patent and Trademark Office*